US010107224B2

(12) United States Patent
Giroud et al.

(10) Patent No.: US 10,107,224 B2
(45) Date of Patent: Oct. 23, 2018

(54) FUEL SYSTEM FOR AN INTERNAL COMBUSTION ENGINE ARRANGEMENT

(71) Applicant: VOLVO TRUCK CORPORATION, Göteborg (SE)

(72) Inventors: François Giroud, Lyons (FR); Thomas Grange, Lyons (FR); Guillaume Millet, Luzinay (FR)

(73) Assignee: Volvo Truck Corporation, Göteborg (SE)

( * ) Notice: Subject to any disclaimer, the term of this patent is extended or adjusted under 35 U.S.C. 154(b) by 0 days.

(21) Appl. No.: 15/037,080

(22) PCT Filed: Dec. 6, 2013

(86) PCT No.: PCT/IB2013/003110

§ 371 (c)(1),
(2) Date: May 17, 2016

(87) PCT Pub. No.: WO2015/082954

PCT Pub. Date: Jun. 11, 2015

(65) Prior Publication Data

US 2016/0298568 A1 Oct. 13, 2016

(51) Int. Cl.
*F01N 3/00* (2006.01)
*F02D 41/30* (2006.01)
(Continued)

(52) U.S. Cl.
CPC ..... *F02D 41/3082* (2013.01); *F01N 3/0253* (2013.01); *F01N 3/36* (2013.01);
(Continued)

(58) Field of Classification Search
CPC ..... F01N 3/0253; F01N 2610/1466; F01N 2610/1493; F02D 2200/0602; F02M 55/00
See application file for complete search history.

(56) References Cited

U.S. PATENT DOCUMENTS 6,076,507 A * 6/2000 Blizard ..... F02D 33/006 123/198 DB
2008/0245058 A1 10/2008 Boddy et al.
2010/0212290 A1 8/2010 Thiagarajan et al.

FOREIGN PATENT DOCUMENTS

DE 102008038448 A1 3/2010
DE 102009017892 A1 10/2010
DE 102009047488 A1 * 6/2011 ..... F01N 3/0253

OTHER PUBLICATIONS

Machine English translation of DE102009047488.*
International Search Report (dated Aug. 14, 2014) for corresponding International App. PCT/IB2013/003110.

* cited by examiner

*Primary Examiner* — Mark Laurenzi
*Assistant Examiner* — Jason Sheppard
(74) *Attorney, Agent, or Firm* — WRB-IP LLP

(57) ABSTRACT

In a fuel system for delivering pressurized fuel both to an internal combustion engine and to an exhaust installation, the fuel system includes two separate branches for delivering fuel to the internal combustion engine and to the exhaust installation, and includes a primary fuel pump delivering fuel to both branches of the fuel supply circuit. The primary fuel pump output is controllable independently of the engine speed. The pump output may be controlled such that the pressure of fuel in the fuel supply circuit depends on whether fuel is to be delivered to the exhaust installation. The fuel system may include a hydraulically controlled shut-off valve arrangement which is forced to switch depending on the pressure in the fuel supply circuit.

24 Claims, 3 Drawing Sheets

(51) Int. Cl.

| | |
|---|---|
| ***F01N 3/36*** | (2006.01) |
| ***F02M 55/00*** | (2006.01) |
| ***F01N 3/025*** | (2006.01) |
| ***F02D 41/38*** | (2006.01) |

(52) U.S. Cl.
CPC ..... *F02D 41/38* (2013.01); *F02M 55/00* (2013.01); *F01N 2610/03* (2013.01); *F01N 2610/144* (2013.01); *F01N 2610/1493* (2013.01); *F02D 2200/0602* (2013.01)

FUEL SYSTEM FOR AN INTERNAL COMBUSTION ENGINE ARRANGEMENT

BACKGROUND AND SUMMARY

The invention relates to a fuel system for delivering pressurized fuel both to an infernal combustion engine and to an exhaust after-treatment system.

The invention can be applied in fuel systems to be used with internal combustion engine arrangements which may be installed in heavy-duty vehicles, such as trucks, buses and construction equipment. Although the invention will be described with respect to a truck, the invention is not restricted to this particular application, but may also be used in other vehicles or machines, or in fixed internal combustion arrangements driving pumps, generators, or other machinery.

It is now common for internal combustion engine arrangements to be fitted with exhaust after-treatment systems to reduce the amount of noxious substances present in the exhaust gases produced by the combustion of fuel in the internal combustions engine. Such exhaust after-treatment systems may be integrated in an exhaust installation which collects the exhaust gases produced by the combustion of fuel in the internal combustion engine, and which rejects the exhaust gases, for example to the atmosphere. An exhaust after-treatment system may comprise, inter alia, one or several of an oxidation catalyst device, such as a diesel oxidation catalyst device, of a particulate filter, such as a Diesel particulate filter or DPF, or of a reducing catalyst device, such as a NOx reducing catalyst device (typically a selective catalytic reduction catalyst device known as SCR device).

For the operation of such exhaust after-treatment devices, it is in some cases necessary to provide the exhaust installation with fuel. Fuel can for example be used to produce heat, by being burnt or oxidized, or as a reactant in a chemical reaction in a catalytic converter. Typically, fuel may be injected in the exhaust gas stream upstream of an oxidation catalyst where it may be oxidized to produce heat, for example for regenerating a particle filter or for heating up the gases to achieve a suitable gas temperature for them to react in a catalyst. Fuel may be fed to a burner in the exhaust installation, also to provide heat to the exhaust gases and installation. Fuel may be injected upstream of a catalyst device to react in said catalyst device with some of the substances contained in the exhaust gases. For example, the exhaust installation, may comprise a fuel nozzle, which may be part, of a controlled fuel injector, for injecting fuel in the exhaust installation, for example in an exhaust pipe or a mixing chamber of the exhaust installation.

Therefore, in such exhaust installations, there is a need to deliver pressurized fuel to the exhaust installation. To that effect, many known installations comprise a dedicated fuel pump.

Document US-2008/0245058 describes a fuel system where an engine fuel supply system 20 has a low pressure fuel pump 22 that pumps fuel from a tank 21 to a conduit 23. The conduit 23 connects to a high pressure fuel pump 24, which supplies a high pressure common rail 25. Fuel injectors 26 admit fuel from the common rail 25 to the cylinders of a diesel engine (not shown), which is operative to produce the exhaust carried by the exhaust line 30. A high pressure relief valve 27 can return fuel from the common rail 27 to the fuel tank 21. The flow regulating valve 11 is configured to selectively admit fuel from the conduit 23. As stated in the document, drawing fuel for exhaust line fuel injection from the conduit 23 has the advantage of eliminating the need for an additional fuel pump separate from the engine fuel supply system 20, but has the disadvantage that the pressure in the conduit 23 varies significantly during normal operation of the engine, because the low pressure fuel pump of an engine fuel supply system is typically mechanically driven by the engine itself and therefore delivers an output flow which is substantially proportional to the engine speed. The fact that the pressure delivered to the exhaust system may vary a lot may have an impact on the accuracy of the control of the quantity of fuel which is delivered to the exhaust system.

It is desirable to provide a simplified fuel system which may allow a good control of the quantity of fuel injected in the exhaust system without requiring expensive or complex components for the exhaust fuel injection system.

By the provision of a fuel system where the primary fuel pump output is controllable independently of the engine speed, the advantage is given that, in the context of a common primary pomp for both branches of the fuel supply circuit, it is possible to adjust the primary pump output depending on the needs of the exhaust installation, which are not always correlated to the speed of the engine.

Controlling the pump output may be understood as controlling one or several characteristics of the flow of fuel which is delivered by the primary fuel pump. For example, controlling the pump output may comprise controlling the pressure and/or the flow rate of the flow of fuel delivered by the primary fuel pump at its outlet.

Further advantages and advantageous features of aspects of the invention are disclosed in the following description.

The pump output may be controlled such that the pressure of fuel in the fuel supply circuit depends on whether fuel is to be delivered to the exhaust installation. In particular the fuel system may comprise a controller for controlling the primary fuel pump output accordingly. The controller may be configured to control the pump output such that the pressure of fuel in the fuel supply circuit depends on whether fuel is to be delivered to the exhaust installation. In an embodiment the pump-output is controlled such that the pressure of fuel in the fuel supply circuit delivered by the primary fuel pump remains below a threshold pressure when no fuel is to be delivered to the exhaust installation and exceeds a threshold pressure when fuel is to be delivered to the exhaust installation. This may optimize the energy consumption of the fuel system. It may also allow better control of the operation of the injection of fuel in the exhaust installation.

The fuel system may comprise a hydraulically controlled valve arrangement which is hydraulically controlled by the pressure in the fuel supply circuit. For example, it may comprise a hydraulically controlled shut-off valve which is forced to switch between an open and a shot-off state depending on the pressure in the fuel supply circuit compared to a threshold pressure. Such valve arrangement may thus be controlled by controlling the primary fuel pump output. Such shut-off valve arrangement may be an on/off valve arrangement rather than a proportional valve.

For example, the fuel system may comprise, in the exhaust branch, a hydraulically controlled exhaust fuel shut-off valve which is forced to switch between a shut-off state and an open state depending on the pressure upstream of the exhaust fuel shut-off valve arrangement compared to a threshold pressure. For example, the hydraulically controlled exhaust fuel shut-off valve is forced to open when the pressure upstream of the exhaust fuel shut-off valve arrangement exceeds a threshold pressure.

The fuel system may comprise a purge system comprising a purge control valve arrangement which has an inlet contestable to a pressurized purge fluid source and an outlet which is connected to the exhaust branch of the fuel supply circuit. Such purge system may allow purging at least part of the exhaust branch of the fuel supply circuit when no fuel is to be delivered to the exhaust installation, for preventing clogging.

In such a system, the purge control valve arrangement may comprise at least one hydraulically controlled purge fluid control valve having a hydraulic control port which is connected to the fuel supply circuit. Such purge control valve arrangement may thus be controlled by controlling the primary fuel pump output.

In a fuel system having such a purge system and having an exhaust fuel shut-off valve arrangement, the purge control valve arrangement may comprise a shut-off valve which is forced to a shut-off state when the pressure in the fuel supply circuit upstream of the fuel shut-off valve arrangement exceeds a threshold pressure. This allows control of the purge control valve whatever the state of the exhaust fuel shut-off valve arrangement.

In one embodiment, the fuel system comprises a purge control valve arrangement, which is arranged fluidically between a pressurized purge fluid source and the exhaust branch of the fuel supply circuit, and which is hydraulically controlled by the pressure of fuel in the fuel supply circuit. The purge control valve arrangement may be configured to be open when the pressure of fuel in the fuel supply circuit is comprised between a first threshold pressure and a second threshold pressure, and to be closed when the pressure of fuel in the fuel supply circuit is lower than the first threshold pressure and higher than the second threshold pressure. This allows a least two operating pressure ranges where the purge system is closed. For example, the purge control valve arrangement comprises at least two hydraulically controlled shut-off valves which are arranged in series between the pressurized purge fluid source and the exhaust branch of the fuel supply circuit, which are both hydraulically controlled by the pressure of fuel in the fuel supply circuit, where one of the valves is a normally open valve and the other is a normally closed valve, and where each valve has a different threshold pressure for switching from a rest position to a forced position. In such system, the exhaust fuel shut-off valve may be a hydraulically controlled fuel shut-off valve arrangement which is forced to open when the pressure upstream of the exhaust fuel shut-off valve arrangement exceeds a threshold pressure which is higher than the first threshold pressure and higher than the second threshold pressure. This allows for indirect control of both pressure controlled valve arrangements in at least three different discrete configurations:

both the fuel injection in the exhaust, system and the purge system closed, only the fuel injection in the exhaust system is opened, or only the purge system is opened.

The three configurations are selectively controlled only by controlling the output of the primary fuel pump. A hydraulic control port of the purge fluid control valve arrangement may be connected to the exhaust branch upstream of an exhaust fuel shut-off valve.

Preferably, the fuel supply circuit comprises no additional pump in the fuel flow between the primary fuel pump and a nozzle for injecting fuel into an exhaust gases stream.

Optionally, in certain embodiments the fuel system may comprise a controller unit for controlling the primary fuel pump in such a way to pump back fuel from the fuel supply circuit.

The fuel system may comprise an electric motor for driving the primary fuel pump.

The invention also relates to an internal combustion engine arrangement comprising:

an internal combustion engine having at least one engine cylinder in which fuel is combusted to provide mechanical energy to a piston;

an exhaust, installation in which flow exhaust gases collected from the internal combustion engine;

wherein the internal combustion engine arrangement comprises a fuel system according having any of the above features, wherein fuel is supplied to the at least one engine cylinder by the engine branch of the fuel supply circuit and wherein fuel is supplied to the exhaust installation by the exhaust branch of the fuel supply circuit.

The invention also relates to a method for controlling a primary fuel pump for delivering pressurized fuel both to an internal combustion engine and to an exhaust installation through a fuel supply circuit, characterized by the steps of:

controlling the primary fuel pump output such that the pressure of fuel delivered by the primary fuel pump in the fuel supply circuit remains below a threshold pressure when no fuel is to be delivered to the exhaust installation, and controlling the primary fuel pump output such that the pressure of fuel delivered by the primary fuel pump in the fuel supply circuit exceeds the threshold pressure when fuel is to be delivered to the exhaust installation.

Further advantages and advantageous features of the method according to an aspect of the invention are disclosed in the following description.

The method may include the step of varying the pressure of fuel delivered by the primary fuel pump in the fuel supply circuit within a high range depending on fuel delivery requirements of in the exhaust installation, wherein said high range is above the threshold pressure. This may allow adapting the fuel injection conditions in the exhaust installation to the specific operating conditions of the exhaust installation, preferably without impacting the fuel injection conditions in the internal combustion engine The method may include the step of varying the pressure of fuel delivered by the primary fuel pump in the fuel supply circuit within a low range depending on fuel delivery requirements in the internal combustion engine, wherein said low range is below the threshold pressure. This may allow adapting the fuel delivery conditions to the internal combustion engine to the specific operating conditions of the internal combustion engine, preferably without impacting the fuel injection conditions in the exhaust installation.

The method may include the step of controlling the speed of an electric motor driving the primary fuel pump.

The invention also relates to a control unit for controlling a primary fuel pump, the control unit being configured to perform the steps of the method including any of the above method features.

BRIEF DESCRIPTION OF THE DRAWINGS

With reference to the appended drawings, below follows a more detailed description of embodiments of the invention cited as examples.

In the drawings.

DETAILED DESCRIPTION

Figure 1:
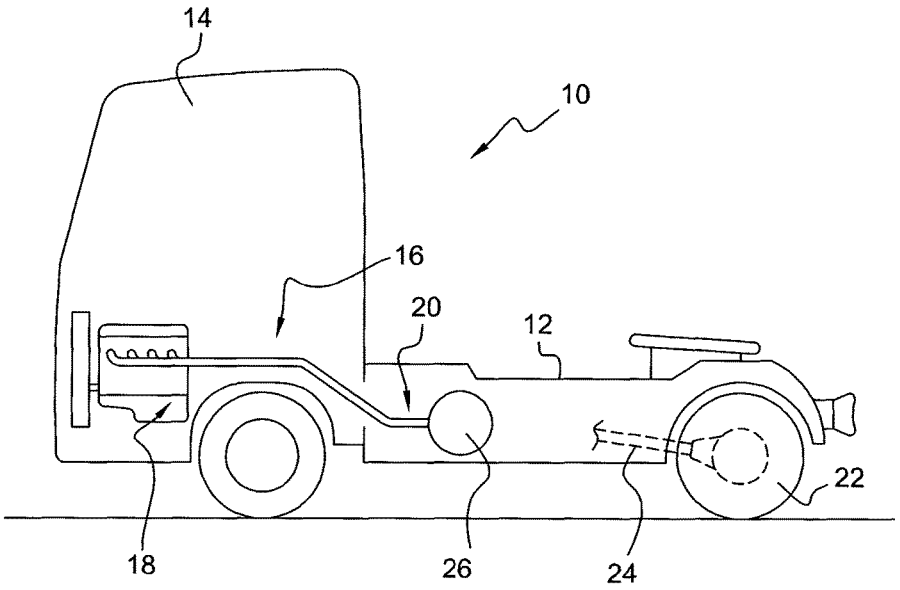
FIG. 1 is a general schematic view of a vehicle equipped with an internal combustion engine arrangement which may be equipped with a fuel system according to the invention.

On FIG. 1 is shown an automotive vehicle 10. The automotive vehicle may be a truck, such as a tractor for trailing a semi-trailer, having a chassis 12 and a cabin 14 for accommodating a driver. It comprises an internal combustion engine arrangement 16 which includes an internal combustion engine 18 and an exhaust installation 20. The internal combustion engine 18 drives a set of driven wheels 22 of the vehicle, through an appropriate transmission 24.

In a known manner, the internal combustion engine 18 may have at least one engine cylinder (not shown) in which fuel is combusted to cause the movement of a piston (not represented). The movement of the piston is transferred to the transmission 24. The engine may be a reciprocating piston engine or a rotary engine. It may be a spark ignition engine or a compression ignition engine such as a Diesel engine.

The exhaust installation 20 collects the exhaust gases produced by the combustion of fuel in the internal combustion engine 18, and rejects the exhaust gases, for example to the atmosphere.

The exhaust installation 20 may include an exhaust manifold and various exhaust pipes. It may include an exhaust after-treatment system 26 for reducing the amount of noxious substances present in the exhaust gases before they are released to the atmosphere, the exhaust after-treatment system 26 may comprise, inter alia, one or several of an oxidation catalyst device, such as a diesel oxidation catalyst device, and/or of a particulate filter, such as a Diesel particulate filter or DPF, and/or of a reducing catalyst device, such as a NOx reducing catalyst device (typically a selective catalytic reduction catalyst device known as SCR device), and/or a clean-up catalyst device to remove by-products of the chemical reactions occurring in one of the above catalytic devices. The exhaust installation may comprise also a muffler for reducing the noise carried by the exhaust gases.

For the operation of such exhaust after-treatment devices, it is in some cases necessary to pro vide the exhaust installation with fuel. Fuel can for example be used to produce heat, by being burnt or oxidized, or be used as a reactant in a chemical reaction in a catalyst. Typically, fuel may be injected in the exhaust gas stream upstream of an oxidation catalyst where it may be oxidized to produce heat, for example for regenerating a particle filter or for heating up the gases to achieve a suitable gas temperature for them to react in a further catalyst. Fuel may be fed to a burner in the exhaust installation, also to provide heat to the exhaust gases and installation. Fuel may be injected upstream of a catalyst device to react in said catalyst device with some of the substances contained in the exhaust gases. For example, the exhaust installation may comprise a fuel nozzle, which may be, or not be, part of a controlled fuel injector unit, for injecting fuel in the exhaust installation, for example in an exhaust pipe or a mixing chamber of the exhaust installation.

The internal combustion engine arrangement further comprises a fuel system for delivering pressurized fuel both to the internal combustion engine 18 and to the exhaust installation 20.

Such fuel system is configured such that fuel is supplied to the at least one engine cylinder, by an engine branch of the fuel supply circuit, and such that fuel is also supplied to the exhaust installation, by an exhaust branch of the fuel supply circuit. The fuel system is preferably configured to supply fuel simultaneously to both the engine and to the exhaust installation.

The fuel system 28 comprises a primary fuel pump 30, the output of which is controllable independently of the engine speed, i.e. the speed of the internal combustion engine 16. For example, the output of the pump may be altered without altering the engine speed, and/or it may be altered non-proportionally with the engine speed.

The pump may thus have at least one control parameter, different from the engine speed, which may be modified to modify the pump output.

A first embodiment of such a fuel system will now be described in relation to FIG. 2.

In the shown example, the primary fuel pump is driven by an electric motor 32. Such an electrically driven pump 32 may be driven independently of the operation of the engine, and especially independently of the engine rotation speed. In other words, the speed of the pump is not linked to the speed of the engine by a fixed ratio. Therefore the output of the fuel pump may be adjusted by adjusting the speed of the electric motor rather than being directly tributary of the engine speed.

In a variant, the primary fuel pump could be driven by two sources of mechanical movement, one being the mechanical movement of the internal combustions engine and the other being the mechanical movement of the electric motor. In such a case, the movements of the internal combustions engine and of the electric motor could be combined through a planetary gear having a first input driven by the internal combustion engine, a second input driven by the electric motor and one output driving the primary fuel pump 30. In such a system, the speed of the output driving the pump would be a linear combination of the speeds of the internal combustion engine and of the electric motor, so that the speed of the pump is not linked to the speed of the engine by a fixed ratio, but can to the contrary be adjusted thanks to the electric motor. In a further variant, the fuel pump 30 could be connected separately to the internal combustion engine and to the electric motor through clutches which would be opened or closed depending on which of The engine or the electric motor is chosen as the source of driving power of the pump. In such a variant, the pump output is not totally independent from the engine speed, because a variation of the engine speed will affect the pump output if all other control parameters of the pump are equal, but it is nevertheless independent in the sense that it is possible to modify the pump output using other control parameters such as the speed of the electric motor in this case.

The electric motor could be replaced by any other type of motor independent from the internal combustion engine 16, the speed of which could be altered to control the pump output.

In addition, or alternatively, the output of primary fuel pump 30 can be made controllable independently of the engine speed by providing a variable capacity pump, the capacity of which can be altered to change the pump output. In such a case independent control of the pump output can be achieved by controlling the pump capacity. The pump can then be driven by the internal combustion engine 30, or by an independent motor such as electric motor 32.

In addition, or alternatively, the output of primary fuel pump 30 can be made controllable independently of the engine speed by providing a pump driven by the internal combustion engine through a controllable transmission having multiple speed ratios, such as a gearbox or a continuously variable transmission, the speed ratio of which can be altered to change the pump output. The control parameter allowing independent control of the pump output is then the selected gearbox or transmission speed ratio.

In a preferred embodiment, the primary fuel pump output is made controllable by controlling the pump output flow rate.

The primary fuel pump 30 has an inlet 34 through which it recedes fuel from a fuel tank 36. It she shown embodiment, the primary pump 30 sucks the fuel directly from the tank 36 through a primary filter 35. However, a feed pump could be provided between tank 36 and the primary fuel pump 30 for delivering fuel to the inlet of the primary fuel pump 30.

The primary fuel pump 30 has an outlet 38 through which it delivers pressurized fuel to a fuel supply circuit 40.

The fuel supply circuit 40 has two separate branches: an engine branch 42 for delivering fuel to the internal combustion engine and an exhaust branch 44 for delivering fuel to the exhaust installation.

As shown on FIG. 1, the two branches can be connected to the pump outlet 38 through a common portion 46 of the fuel supply circuit. However, each branch could be separately connected to the outlet of the primary pump 30. The common portion 46 of the fuel supply circuit 40 may be equipped with a filter 48.

The engine branch 42 of the fuel supply circuit delivers fuel to the engine cylinder(s). The engine branch 42 forms a fluid flow path for fuel from the primary fuel pump 30 to the to the engine cylinder(s).

The engine branch of the fuel supply circuit may comprise a high pressure stage 45, with one or several high pressure pumps for pressurizing fuel to pressure levels exceeding 100 bars, or even exceeding 1000 bars. The high pressure stage may be of the common rail type or of the unitary injector-pump type, or of any other type. The primary pump 30 would in such a case form a so-called low pressure fuel pump for the fuel system. Such a low pressure fuel pump 30 could typically deliver fuel under a pressure which is equal to or below 20 bars, preferably equal to or below 10 bars.

The engine branch 42 can typically have at least one-injector, preferably several injectors, for injecting fuel into an intake manifold of the internal combustion engine, far injecting fuel into a pre-combustion chamber of the engine, or for injecting the fuel directly in the engine cylinder(s). The engine branch 42 of the fuel supply circuit 40 may comprise a fuel return line (not shown) for returning excess fuel to the fuel tank 36, and/or a recirculating line for recirculating the excess fuel for example to the inlet or to the outlet of the primary fuel pump 30.

The exhaust branch 44 of the fuel supply circuit carries fuel which is not to be injected in the engine cylinders. In other words, fuel carried by the exhaust branch will be delivered to the exhaust installation without going through the engine cylinders. The exhaust branch 44 forms a fluid flow path for fuel from the primary fuel pump 30 to the exhaust installation 20.

The exhaust branch 44 and the engine branch 42 are disjoined one from the other from a separation point 43 which is upstream of the engine cylinders. Preferably, in the case where the fuel, system has a high pressure stage, the exhaust, branch 44 and the engine branch 42 are disjoined one from the other from a separation point 43 which is upstream of the high pressure stage.

The fuel supply circuit 40 may be configured such a variation of the primary fuel pump output will result in a corresponding variation of the fuel pressure in the fuel supply circuit 40, especially in the exhaust branch 44 of the fuel supply circuit 40. Thus, controlling the output flow rate of the pump 30 results in controlling the pressure in the exhaust branch 44 of the fuel supply circuit 40.

Figure 2:
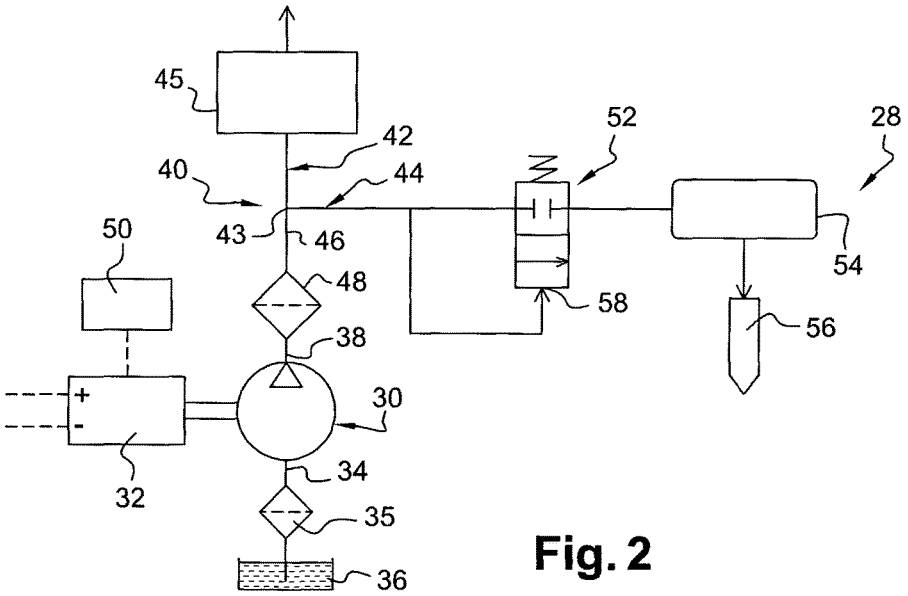
FIG. 2 is a schematic diagram showing some components of a first embodiment of a fuel system according to the invention

One can see on FIG. 2 that the electric motor 32 driving the primary pump 30 is preferably electronically controlled by a controller 50. The controller 50 may be an electronic control unit. A controller 50 may typically comprise one or several of a microprocessor, memory (RAM and/or ROM), input and output connections, transceivers for connection to a wired or wireless network such as a CAN-bus, etc . . . . Thus the controller 50 controls the primary fuel pump output.

The controller may be a standalone controller, or integrated in a controller controlling other functions of the internal combustion engine arrangement, especially a controller controlling the main engine functions. The controller 50 may receive, directly or indirectly, information regarding one or several operating parameters of the internal combustion engine arrangement 16, including operating parameters of the internal combustion engine 18, of the exhaust installation 20, and/or of the vehicle or of the equipment which is driven thanks to the internal combustion engine arrangement 16. The controller may for example be connected to a databus, such as a so-called CAN-bus where such kind of information circulates.

FIG. 2 represents a first embodiment of the exhaust branch 44 of a fuel system according to the invention.

In this example, the exhaust branch 44 of the fuel supply circuit comprises an exhaust fuel shut-off valve arrangement 52, an exhaust fuel dosing valve 54 and an exhaust nozzle 56 which are arranged in series, in that order along the flow of fuel in the exhaust branch 44. The exhaust branch 44 comprises suitable pipes and conduits which may necessary between the different components and for connecting said components to the common portion 46 of the fuel supply circuit 40. For example, the exhaust branch 44 has a first pipe member which fluidically connects the separation point 43 to an inlet port of the exhaust fuel shut-off valve arrangement 52, a second pipe member which fluidically connects an outlet port of the exhaust fuel shut-off valve arrangement 52 to an inlet port of the exhaust fuel dosing valve 54, and may comprise a third pipe member which fluidically connects an outlet port of the exhaust fuel dosing valve 54 to the exhaust nozzle 56.

The exhaust nozzle 56 is provided to inject fuel in the exhaust installation, for example directly in an exhaust pipe or in a mixing chamber where flows a flow of exhaust gases collected from the engine cylinders), or in an apparatus pertaining to the exhaust installation such as a catalytic device, a fuel burner, etc . . . . The exhaust nozzle 56 is preferably a passive component, i.e. a component which is not electronically controlled. In its simplest form the nozzle 56 may be a body having a cavity to which fuel is delivered from the other components of the exhaust branch 44, said cavity having one or several calibrated holes.

The exhaust fuel dosing valve 54 controls the amount of fuel delivered through the nozzle.

In this embodiment, it is an electromagnetically controlled valve, e.g. a solenoid valve, which can control the timing of fuel infection through the nozzle. It can be a simple on/off valve, or a proportionally controlled valve to control the flow and/or pressure of fuel delivered by the exhaust branch 44 though the nozzle 56. The exhaust fuel dosing valve 54 can be controlled by pulse-width modulation preferably it has known opening and closing times to accurately control the amount of fuel delivered through the nozzle. It can be controlled by die controller 50 or by another controller, including a dedicated controller.

The exhaust fuel dosing valve 54 and the exhaust nozzle 56 can be united in a unitary 30 body forming an integrated controlled injector unit. Alternatively, the exhaust fuel dosing valve 54 and the exhaust nozzle 50 can be separate physical entities fluidically connected by a fuel conduit.

The exhaust fuel shut-off valve arrangement 52 controls the flow of fuel in the exhaust branch 44 of die fuel supply circuit 40. It can advantageously be a hydraulically controlled shut-off valve arrangement which is forced to switch between an open and a shut-off state depending on the fuel pressure in the fuel supply circuit 40 compared to a threshold pressure.

In the embodiment of FIG. 2, a role of this valve arrangement can be that of a safety valve which be used to prevent any undesired injection of fuel, in the exhaust system even if the dosing valve 54 remains blocked in an open position.

The fuel shut-off valve arrangement 52 which may be configured so that it is forced to open when the pressure upstream of the fuel shut-off valve exceeds a threshold pressure.

For example, the exhaust fuel shut-off valve arrangement 52 may have a hydraulic control port 58 which is fluidically connected to the fuel supply circuit 40. In such a case, the control pressure which will determine the state of the shut-off valve arrangement is directly related, preferably proportional and most preferably equal, to the pressure of fuel delivered by the primary pump. Advantageously, the open or shut-off state of the shut-off valve can be modified by controlling the output of the primary pump.

More precisely, the hydraulic control port 58 of the exhaust fuel shut-off valve 52 may be connected to the exhaust branch 44 of the fuel supply circuit, i.e. downstream of the separation point 43 where the exhaust branch 44 of the supply circuit 40 disjoins from the engine branch 42. However, in the shown embodiment, the hydraulic control port 58 of the exhaust fuel shut-off valve 52 is connected to the exhaust branch 44 upstream of the exhaust fuel shut-off valve 52.

The hydraulic control port 58 may be in fact connected to the inlet port of the exhaust fuel shut-off valve 52 by a conduit integrally formed in the valve body, thus requiring no additional external pipe.

The exhaust fuel shut-off valve arrangement 52 is preferably a passive valve arrangement, i.e. a component which is not electronically controlled, in the shown embodiment, the fuel shut-off valve arrangement 52 comprises a single hydraulically controlled shut-off valve, it may be, as shown, a 2 position valve having an inlet and an outlet, where one position corresponds to the open state of the valve, with the inlet being fluidically connected to the outlet and the other position corresponds to the shut-off state of the valve, with the inlet being fluidically disconnected from the outlet. The shut-off valve 52 can be a valve with a linearly sliding valve core sliding between an open and a shot-off position. However, another type of valve or a combination of valves can be used to form the valve arrangement.

In the shown embodiment, the hydraulically controlled exhaust fuel shut-off valve 52 is elastically biased towards a shut-off position, for example by a spring acting on one side of the valve core, against the action of the pressure at its hydraulic control port 58 which may exert its force against the other side of the valve core. The valve is configured such that if the pressure at its hydraulic control port 58 is inferior to a threshold pressure, the spring keeps the valve in a first position, here the shut-off position where no fuel may pass though the valve, and, if the pressure at its hydraulic control port 58 is superior to a threshold pressure, then the action of pressure forces the valve to a second position, here the open position where fuel can flow through the valve 52. As from above, the hydraulically controlled exhaust fuel shut-off valve 52 in FIG. 2 is a normally shut-off valve such that in the absence of pressure at its hydraulic control port 58, the valve 52 shuts-off fuel delivery.

A method for controlling the primary fuel pump could include the following steps.

- controlling the primary fuel pump 30 output such that the pressure of fuel delivered by the primary fuel pump in the fuel supply circuit remains below a first threshold pressure when no fuel is to be delivered to the exhaust installation; and
- controlling the primary fuel pump 30 output such that the pressure of fuel delivered by the primary fuel pump in the fuel supply circuit exceeds a second threshold pressure when fuel is to be delivered to the exhaust installation.

The first and second threshold pressures can be equal. They are then preferably equal to the threshold pressure at which the hydraulically controlled shut-off valve arrangement shifts from between its open and shut-off states. Alternatively, the second threshold can be higher than the first threshold pressure. In such a case, the threshold pressure at which the hydraulically controlled shut-off valve arrangement shifts from between its open and shut-off states is preferably comprised between the first and second thresholds.

A method for controlling a primary fuel pump may include the step of varying the pressure of fuel delivered by the primary fuel pump 30 in the fuel supply circuit 40 within a low range, depending on fuel delivery requirements in the internal combustion engine, wherein said low range is below the threshold pressure at which the hydraulically controlled shut-off valve arrangement shifts from between its open and shut-off states.

Such control methods allow indirect control of the hydraulically controlled shut-off valve arrangement. Such methods can be implemented by the controller 50.

For example, the exhaust fuel shut-off valve 52 may be configured to switch from shut-off state to open state at a threshold pressure of 7 bars. In such a case, when no fuel is to be delivered to the exhaust installation, the electric motor 32 driving the primary fuel pump 30 may be controlled by controller 50 such that the pump generates in the fuel supply circuit 40 a low pressure level which may be for example in a low range of 3 to 6 bars, i.e. below the threshold pressure. That low pressure level can be fixed, or can vary within the low range, for example depending on the engine operating parameters. When fuel is to be delivered to the exhaust installation, the electric motor 32 driving the primary fuel pump 30 may be controlled by controller 50 such that the pump generates in the fuel supply circuit 40 a higher pressure which may be for example superior to 7 bars, or superior to 8 bars depending on any uncertainty on the exact value of the threshold pressure. This may be achieved by increasing the speed at which the primary fuel pump is driven. This causes the exhaust fuel shut-off valve 52 to switch from shut-off state to open state, allowing fuel to reach the exhaust fuel dosing valve. Control of the amount of fuel effectively delivered to the exhaust installation can then be performed by proper control of the exhaust fuel dosing valve 54. The higher pressure level delivered by the primary fuel pump 30 may be a fixed predetermined value, for example 8 bars, or may vary within a higher range, for example between 8 and 10 bars. When no more fuel is needed in the exhaust installation, the controller controls the electric motor so as to reduce the output of the primary fuel pump 30 back to a low pressure value, inferior to the threshold pressure of 7 bars.

One can note that when the pump is operated to deliver pressure above the threshold pressure, that same pressure is delivered to the engine branch 42 of the fuel supply circuit, although such higher pressure is not needed in the engine branch. This may happen independently of the engine's operational needs. In most cases, especially in case there is a high pressure stage in the engine branch 42, the higher pressure delivered by the primary pump will not change the functioning of the engine. However, in some configurations, it might be useful or even necessary to install a pressure limiter in the engine branch 44.

Thanks to the above, the exhaust fuel shut-off valve arrangement 52 can be controlled solely by con trolling the output of the primary fuel pump 30, without itself being an electronically controlled valve arrangement, i.e. without comprising a solenoid valve.

Figure 3:
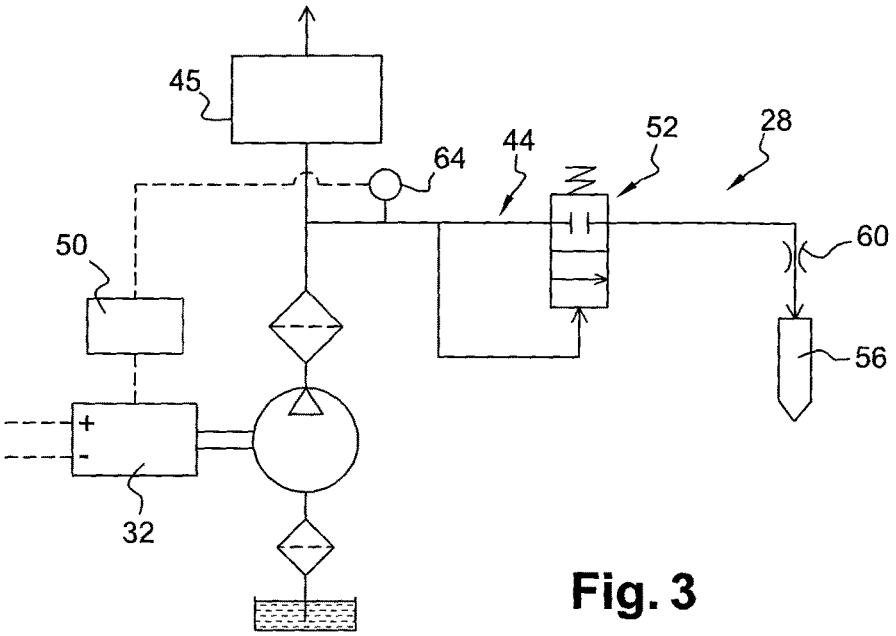
FIG. 3 to 6 are schematic diagrams showing some components of farther embodiments of a fuel system according to the invention.

A second embodiment of a fuel system is shown on FIG. 3 where the only difference relies in that there is no more an exhaust fuel dosing valve in the exhaust branch 44 of the fuel supply circuit. Instead, a flow restriction 60 is provided in the exhaust branch 44, preferably downstream of the exhaust fuel shut-off valve arrangement 52. The flow restriction can be calibrated orifice. It can be upstream of the nozzle 56, or within the nozzle, or it could be integrated in the exhaust fuel shut-off valve arrangement 52. The flow restriction may be in fact by the outlet hole(s) of the nozzle. All other components may be identical to those found in embodiment of FIG. 2 so that their description will not be repeated.

In this embodiment, as soon as the exhaust fuel shut-off valve arrangement 52 switches to its open state upon proper control of the primary fuel pump output, fuel is delivered to the exhaust installation though the nozzle 56. In such a case, the flow rate of fuel delivered to the exhaust installation may be controlled by proper control of the primary pomp output, such as by controlling the speed of the motor 32 driving the pump 30. For example, at a first speed of the pump may correspond a fuel pressure of 8 bars in the exhaust branch 44, which involves a first flow rate through the flow restriction 60, while at a second speed of the pump may correspond a pressure of 10 bars in the exhaust branch 44, which may involve a second flow rate through the flow restriction. Based on the flow rate thus obtained, the overall quantity of fuel delivered can be controlled by controlling the opening time of the fuel shut-off valve 52, this being achieved by controlling the amount of time the pressure in the exhaust branch is maintained above the threshold pressure by proper control of the primary pump 30 output.

In other words, a method for controlling the primary fuel pump 30 may include the step of varying the pressure of fuel delivered by the primary fuel pump in the fuel supply circuit within a high range depending on fuel delivery requirements of the exhaust installation, wherein said high range is above the threshold pressure at which the hydraulically controlled exhaust fuel shut-off valve arrangement 52 shifts from between its open and shut-off states In the embodiment of FIG. 2 where accurate control of the flow rate delivered to the exhaust installation is achieved with the exhaust fuel dosing valve 54, it may not be necessary to have a very accurate control of the actual pressure in the fuel supply circuit. Therefore, control of the primary pump output does not need to be very precise, and thus, there may not be the need for a pressure sensor in the exhaust branch of the supply circuit. All which may be needed may be a predefined output, e.g. target speed, of the primary pump 30 which, upon system calibration, shows that the required pressure, above the valve switch pressure threshold, is obtained in the desired range of operating conditions.

In the embodiment of FIG. 3, for better accuracy, it may be useful or necessary to have a pressure sensor 64 in the fuel supply circuit 40, for example in the exhaust branch 44.

The pressure information delivered by that sensor 64 may be fed back to the controller 50. The primary pump output, in this case controlled through the speed at which the pomp is driven by the electric motor 32, may be feedback controlled by the controller 50 to reach as accurately as possible a certain pressure level which corresponds to a desired flow rate through the exhaust branch 44 when the exhaust fuel shut-off valve arrangement 52 is in its open state. Such a pressure sensor 64 can be installed in die exhaust branch upstream of the exhaust fuel shut-off valve 52. However, other locations can be provided for the pressure sensor 64, including downstream of the shut-off valve arrangement 52 or in the engine branch 42. Such pressure sensor arrangement can also be used in a system such as in FIG. 2.

A third embodiment of a fuel system will now be described in relation to FIG. 4. This third embodiment, is based on the first embodiment described in relation to FIG. 2, so that all which has been described in relation to the embodiment of FIG. 2 applies to this third embodiment and will not be repeated.

Figure 4:
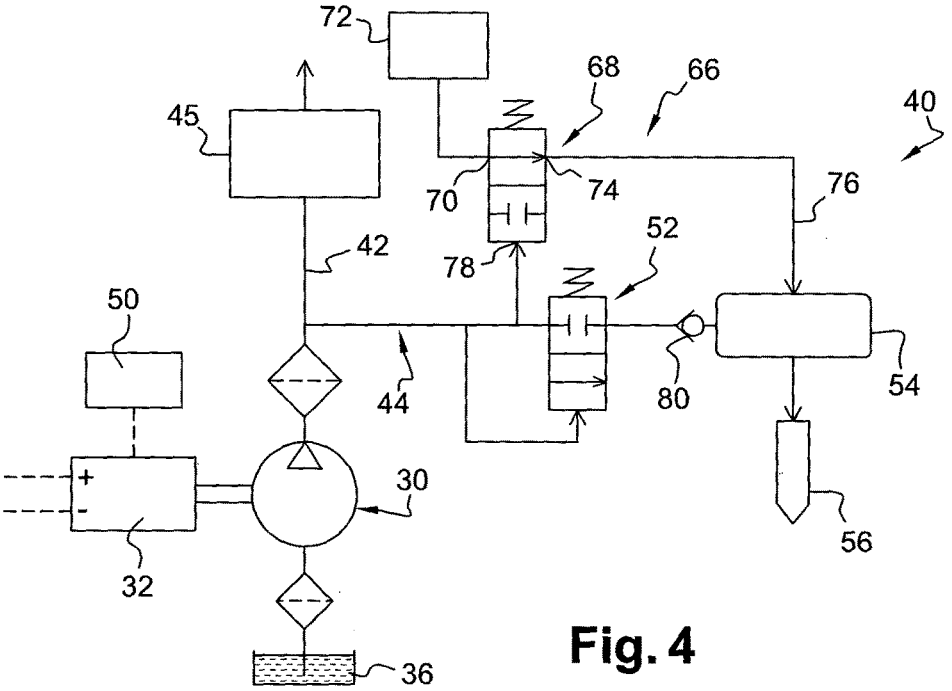

The embodiment of a fuel system according to FIG. 4 further comprises a purge system 66, for example for purging at least part of the exhaust branch 44 of the fuel supply circuit 40 when no fuel is to be delivered to the exhaust installation. Indeed, the exhaust branch 44 is operative only intermittently, only under certain engine operating conditions. The rest of the time, no fuel flows in the exhaust branch 44. During those times, the fuel contained in the exhaust branch 44 may be subject to degradation. For example, the nozzle 56 may be close to the exhaust line in which hot exhaust, gases flow and may therefore be subject to quite high temperatures. The fuel trapped in the nozzle 56 may be subject to coking, which brings the deposit of carbon substances inside the nozzle, which may cause the nozzle to become clogged or partly clogged.

The purge system 66 comprises comprising a purge control valve arrangement 68 which has an inlet 70 collectable to a pressurized purge fluid source 72 and an outlet 74 which is connected to the exhaust branch 44 of the fuel supply circuit 40, preferably upstream of the nozzle 56 for injecting fuel into an exhaust gas stream. The pressurized purge fluid source 72 may be a source of pressurized gas, for example a source of air under pressure. On-board some vehicles, such as heavy duty trucks, there is often at least one pressurized air reservoir which is pro vided for example for the operation of pneumatically operated brake systems, and which could be used as the pressurized purge fluid source.

In the shown system, the outlet 74 of the purge control valve arrangement 68 is connected by a purge pipe 76 to the exhaust fuel dosing valve 54, in view of being able to purge fuel from at least part of the exhaust fuel dosing valve 54 and from the nozzle 56. More precisely, in a preferred embodiment, the purge pipe 76 may be connected to an upstream side of the exhaust fuel dosing valve 54, so that when the exhaust fuel dosing valve 54 is in a closed state, no purge fluid can flow towards the nozzle 56.

A check valve 80 may be installed in the exhaust branch 44 of the fuel supply circuit 40, upstream of its connection to the purge system 66, to prevent any back flow of purge air in the upstream direction in the exhaust branch 44. In the example of FIG. 4, the cheek valve 80 may be located at the fuel inlet of the exhaust fuel dosing valve 54.

Preferably, the purge control valve arrangement 68 may be a hydraulically controlled shut-off valve arrangement which is forced to switch between an open and a shut-off state depending on the pressure of the fuel supply circuit 40, for example in the exhaust branch 44 thereof compared to a threshold pressure.

Preferably, the hydraulically controlled purge control shut-off valve arrangement 68 has a hydraulic control port 78 which is connected to the fuel supply circuit. In such a case, the control pressure which will determine the state of the shut-off valve 68 is directly related, e.g. proportional or equal, to the pressure of fuel delivered by the primary pump 30. Advantageously, the open or shut-off state of the shut-off valve arrangement 68 can thus be modified by controlling the output of the primary pump. As in the example of FIG. 4, the hydraulic control port 78 of the purge control valve arrangement 68 may be connected to the exhaust branch 44 of the fuel supply circuit 40.

The purge control shut-off valve arrangement 68 may be configured so that, it is forced to a closed state when the pressure in the fuel supply circuit exceeds a threshold pressure.

In the shown embodiment, the hydraulic control port 78 of the purge control shut-off valve arrangement 68 is connected to the exhaust branch 44 upstream of the exhaust fuel shut-off valve 52, however, it could alternatively be connected downstream of the exhaust fuel shut-off valve 52. The hydraulic control port 78 may be in fact connected to the fuel supply circuit 40 through a dedicated pipe.

The purge control shut-off valve arrangement 68 is preferably a passive valve arrangement, i.e. a component which is not electronically controlled. In the shown embodiment, the purge control valve arrangement 52 comprises a single hydraulically controlled shut-off valve. It may be, as shown, a 2 position valve having an inlet and an outlet, where one position corresponds to the open state of the valve, with the inlet being fluidically connected to the outlet, and the other position corresponds to the shut-off state of the valve, with the inlet being fluidically disconnected from the outlet. The shut-off valve 52 can be a valve with a linearly sliding valve core sliding between an open and a shut-off position. However, as will be described below, another type of valve or a combination of valves can be used to form the valve arrangement 68.

In the shown embodiment, the hydraulically controlled purge control shut-off valve 68 is elastically biased towards an open position, for example by a spring acting on one side of the valve core, against the action of the pressure at its hydraulic control port 78 which may exert its force against the other side of the valve core. The valve is configured such that, if the pressure at its hydraulic control port 78 is inferior to a threshold pressure, the spring keeps the valve in a first position, here the open position where no purge fluid may pass though the valve 68, and, if the pressure at its hydraulic control port 78 is superior to a threshold pressure, then the action of pressure forces the valve to a second position, here the shut-off position where no purge fluid can flow through the valve 52. As from above, the hydraulically controlled purge control shut-off valve 68 in FIG. 4 is a normally open valve such that in the absence of pressure at its hydraulic control port 78, the valve 68 allows purge fluid to flow through said valve 68.

In the example of FIG. 4, the fuel system comprises both a hydraulically controlled exhaust fuel shut-off valve arrangement 52 and a hydraulically controlled purge control valve arrangement 68, both valve arrangements being controlled by the same pressure in the fuel supply circuit 40. In such case, the threshold pressures of both valve arrangements, i.e. the control pressure at which each valve arrangement switches from one state to the other, can be chosen to be identical. However, this is not compulsory, and the threshold pressures could be different. This can allow for example switching one valve arrangement before the other, or even having an intermediate state of the system where one valve arrangement is switched and not the other. For example, in the example of FIG. 4, the threshold pressure of the purge control valve 68 can be chosen to be lower than the threshold pressure of the exhaust fuel shut-off valve 52.

The same control methods as above can be used for controlling the primary fuel pump 30 in the case of embodiment of FIG. 4. In such a case, the control methods allow indirect control of both hydraulically controlled shut-off valve arrangements 52, 68.

For example, both valves 52 and 68 may be configured to switch at a threshold pressure of 7 bars. In such a case, when no fuel is to be delivered to the exhaust installation, the electric motor 32 driving the primary fuel pump 30 may be controlled by controller 50 such the pump generates in the fuel supply circuit 40 a low pressure level which may be for example in a low range of 3 to 6 bars, i.e. below the threshold pressure. Thus, the fuel shut off-valve 52 is in its shut-off state and the purge control valve 68 is open. However, because the exhaust fuel dosing valve 54 is closed, no purge fluid flows towards the nozzle 56. When fuel is to be delivered to the exhaust installation, the electric motor 32 driving the primary fuel pump 30 may be controlled by controller 50 such that the pump generates in the fuel supply circuit 40 a higher pressure which may be far example superior to 7 bars, or superior to 8 bars depending on any uncertainty on the exact value of the threshold pressure. This may be achieved by increasing the speed at which the primary fuel pump is driven, independently of the engine speed. This causes the exhaust fuel shut-off valve 52 to switch from shut-off state to open state, allowing fuel to reach the exhaust fuel dosing valve. At the same time, the purge control valve 68 is forced to its shut-off position so that no purge fluid can flow towards the exhaust fuel dosing valve 54.

Control of the amount of fuel effectively delivered to the exhaust installation can then be performed by proper control of the exhaust fuel dosing valve 54. When no more fuel is needed in the exhaust installation, the controller controls the electric motor so as to reduce the output of the primary fuel back to the low pressure value, inferior to the threshold pressure of 7 bars. Both the exhaust fuel shut-off valve 52 and the purge control valve 68 switch back to their original position. However, if now the exhaust fuel dosing valve 54 is opened, is will let purge fluid flow through the dosing valve 54 and through the nozzle 56, thereby purging this part of the exhaust branch 44 of the fuel supply circuit 40. When purge is completed, the dosing valve 54 may be closed, bringing back the system to its original state, but without or with only a minimal amount of fuel retained in the part of the exhaust branch 44 which is most exposed to high temperatures.

The fuel system according to FIG. 4 is thereby provided with a purge system which does not require any dedicated electromagnetically controlled valve.

Figure 5:
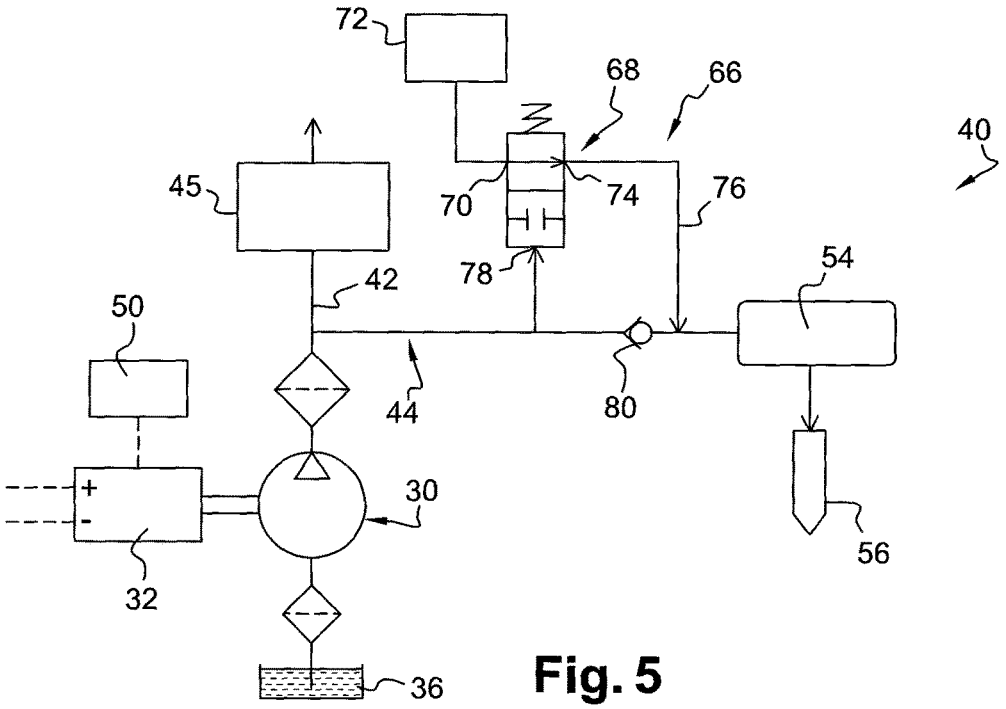

The embodiment shown in FIG. 5 is exactly similar to that of FIG. 4, except that it is not provided with any exhaust fuel shut-off valve arrangement in the exhaust branch 44 of the fuel circuit, apart from the electromagnetically controlled dosing salve 54 showing that the hydraulically controlled purge fluid control valve arrangement 68 can be implemented in the absence of a fuel shut-off valve. In a further non-represented variant, the hydraulically controlled purge fluid control valve arrangement 68 can be implemented together with a non-hydraulically controlled fuel shut-off valve, for example with an electromagnetically controlled fuel shut-off valve.

Figure 6:
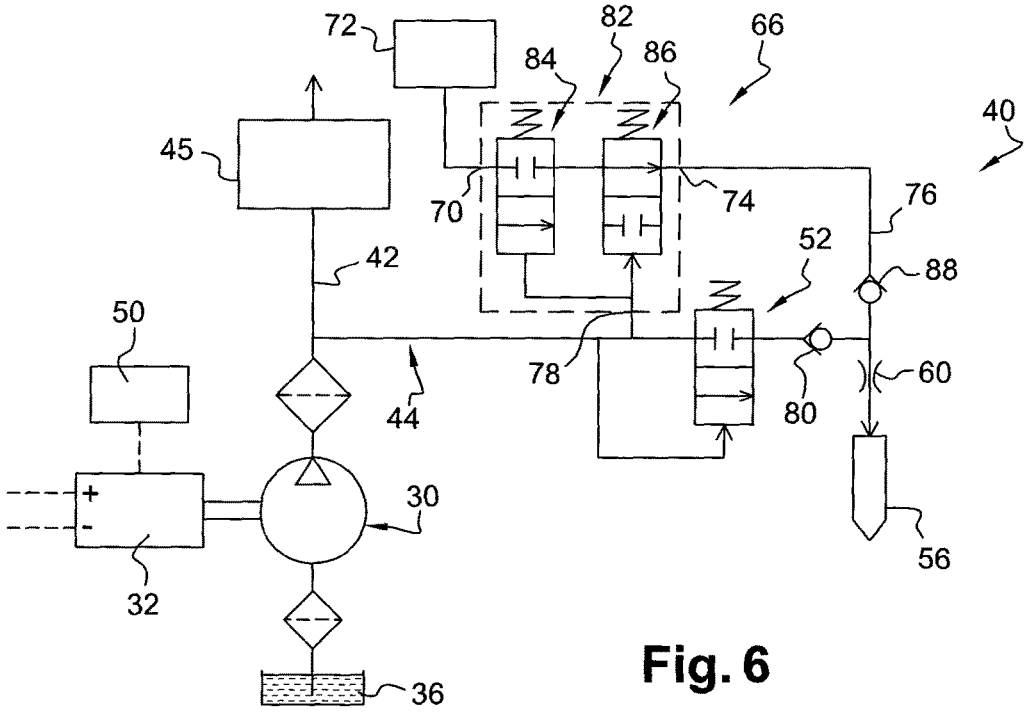

The embodiment of FIG. 6 shows a fuel system where, as in that of FIG. 3, the exhaust branch 44 of the fuel supply circuit does not comprise any electromagnetically controlled valve. The embodiment of FIG. 6 has the additional feature that the fuel system comprises a purge system 66 which is also devoid of any electromagnetically controlled valve.

The purge system 66 of the embodiment of FIG. 6 is similar to that of FIGS. 4 and 5, but comprises a different purge control valve arrangement 82 which has an inlet 70 connectable to the pressurized purge fluid source 72 and an outlet 74 which is connected to the exhaust branch 44 of the fuel supply circuit 40, preferably upstream of the nozzle 56 for injecting fuel into an exhaust gas stream. Therefore, the purge control valve arrangement 82 is arranged fluidically between the pressurized purge fluid source 72 and the exhaust branch 44 of the fuel supply circuit 40. A check valve 88 may be provided between outlet 74 of the purge control valve arrangement 82 and the connection to the exhaust branch 44, for preventing back, flow of fuel in the upstream direction in the purge system 66.

A check valve 80 may be installed in the exhaust branch 44 of the fuel supply circuit 40, upstream of its connection to the purge system 66, to prevent any back flow of purge air in the upstream direction in the exhaust branch 44.

The purge control valve arrangement 82 is hydraulically controlled by the pressure of fuel in the fuel supply circuit. In the shown embodiment, it is a purely hydraulically controlled shut-off valve arrangement which is forced to switch between an open and a shut-off state depending on the pressure in the exhaust branch 44 of the fuel supply circuit 40. In other words, the purge control shut-off valve arrangement 82 is a passive valve arrangement, i.e. a component which is not electronically controlled.

The purge control valve arrangement 82 is open when the pressure of fuel in the fuel supply circuit 40 is comprised between a first threshold pressure and a second threshold pressure, and the purge control valve-arrangement 82 is closed, when the pressure of fuel in the fuel supply circuit 40 is lower than the first threshold pressure and higher than the second threshold pressure.

In the embodiment of FIG. 6, the purge control valve arrangement 82 comprises two hydraulically controlled shut-off valves 84, 86. Each of said two valve 84, 86 may be, as shown, a 2 position valve having an inlet and an outlet, where one position corresponds to the open state of the valve, with the inlet being fluidically connected to the outlet, and tire other position corresponds to the shut-off state of the valve, with the inlet being fluidically disconnected from the outlet. Each of said two valve 84, 86 may be a valve with a linearly sliding valve core sliding between an open and a shut-off position.

The two hydraulically controlled shut-off valves 84, 86 which are arranged in series in the purge fluid circuit between the pressurized purge fluid source 72 and the exhaust branch 44 of the fuel supply circuit.

The two hydraulically controlled shut-off valves 84, 86 are both hydraulically controlled by the pressure of fuel in the fuel supply circuit 40, preferably by the pressure of fuel in the exhaust branch 44. One of the valves is a normally open valve 86 and the other is a normally closed valve 84, and each of the two valves has a different threshold, pressure for switching from a rest position to a forced position.

As can be seen in FIG. 6, the purge control valve arrangement 82 comprises:

- a normally closed valve 84 which is forced to its open position when the pressure in the feet supply circuit exceeds the first threshold pressure, and which is elastically biased towards a closed position, against the action of the pressure at its hydraulic control port and
- normally open valve 86 which is forced to a shut-off position when the pressure in the feet supply circuit exceeds the second threshold pressure, and which is elastically biased towards an open position, against the action of the pressure at its hydraulic control port.

In the example of FIG. 6, the normally open valve 84 is located upstream of the normally closed valve in the purge fluid circuit. However, the reverse location could be possible.

The hydraulically controlled purge control shut-off valve arrangement 82 has a hydraulic control port 78 which is connected to the fuel supply circuit 40. In such a case, the control pressure which will determine the state of the shut-off valve arrangement 82 is directly related, e.g. proportional or equal, to the pressure of fuel delivered by the primary pump 30. Advantageously, the open or shut-off state of the shut-off valve arrangement 82 can thus be modified by controlling the output of the primary pump. As in the example of FIG. 6, the hydraulic control port 78 or the purge control valve arrangement 82 may be connected to the exhaust branch 44 of the fuel supply circuit 40. In the shown embodiment, the hydraulic control port is common for both valves 84, 86 of the valve arrangement, but each valve could have a control port connected independently to the fuel supply circuit 40.

In the shown embodiment, the hydraulic control port 78 of the purge control shut-off valve arrangement 82 is connected to the exhaust branch 44 upstream of the exhaust fuel shut-off valve 52. However, a hydraulic control port of the purge control valve having the higher pressure threshold could alternatively be connected downstream of the exhaust fuel shut-off valve 52. The hydraulic control port 78 may be in fact connected to the fuel supply circuit 40 through a dedicated pipe.

Preferably, the control port(s) of the fuel shut-off valve arrangement 52 and of the fuel purge control valve arrangement 82 are connected to the fuel supply circuit 40 near one another so that they are exposed to substantially the same pressure level.

In such a case, the exhaust fuel shut-off valve arrangement 52 car be configured to switch between its open and shut-off positions at a third pressure threshold level which is higher than both the first and second pressure levels. For example, the first and second pressure levels between which the purge control valve arrangement 82 is open can be chosen at 6 bar and 8 bars respectively. The third threshold pressure level at which the exhaust fuel shut-off valve arrangement 52 switches between its open and shut-off states can be set at 9 bars.

The operation of the system of FIG. 6 may be as follows. When the pressure controlled by the primary pump 30 in the fuels supply system is less than the first pressure threshold level, both the fuel shut-off valve arrangement 52 and the purge control shut-off valve arrangement 82 are shut-off. No fuel is supplied to the exhaust installation and the purge system is inactive because of the normally closed valve 86 remaining in its shut-off state. When fuel is to be delivered to the exhaust installation, the electric motor 32 driving the primary fuel pump 30 may be controlled by controller 50 such that the pump generates in the fuel supply circuit 40 a high pressure level which is superior to the third pressure level, for example superior to 9 bars. This causes the exhaust fuel shut-off valve 52 to switch from shut-off state to open state, allowing fuel to reach the exhaust fuel dosing valve. At the same time, the purge control valve arrangement 82 is forced to its shut-off state, because of the normally open valve 86 being-switches to its shut-off state, so that no purge fluid can flow towards the exhaust branch 44. Control of the amount of fuel effectively delivered to the exhaust installation can then be performed by proper control pump output, as discussed in relation to the embodiment of FIG. 3. When no more fuel is needed in the exhaust installation, the controller controls the electric motor so as to reduce the output of the primary fuel back to an intermediate pressure value, comprised between the first and threshold pressures. With the above exemplary figures, this intermediate value can be of 7 bars. The exhaust fuel shut-off valve 52 switches back to its shut-off state. However, the purge control shut-off valve arrangement 82 is now maintained in its open state, letting purge fluid flow towards the nozzle 56, thereby purging this part of the exhaust branch 44 of the fuel supply circuit 40. When purge is completed, the electric motor 32 driving the primary fuel pump 30 may be controlled by controller 50 such that the pump generates in the fuel supply circuit 40 a low pressure level which may be for example in a low range of 3 to 6 bars, i.e. below the first, second and third threshold pressure levels, so that both fuel shut-off valve arrangement 52 and the purge control shut-off valve arrangement 82 are shut-off.

Further variants, of a fuel system are contemplated which have a primary fuel, pump delivering fuel to both branches of the fuel, supply circuit wherein the primary fuel pump output is controllable independently of the engine speed. Those variants would be characterized in that none of the exhaust fuel shut-off valve arrangement and of the closing valve would be controlled depending on the pressure in the fuel supply circuit (for example one or both of these being electromagnetically controlled or controlled by another pressure). Such variants could exhibit only one, or both, of the exhaust fuel shut-off valve arrangement and of the dosing valve. Such variants may be devoid of a purge system, or may comprise such a purge system. In the latter case, the purge system may have a purge control valve arrangement comprising at least one hydraulically controlled purge fluid shut-off valve having a hydraulic control port which is connected to the fuel supply circuit.

It can be noted that, at least in some embodiments, the primary fuel pump 30 may be controlled in such a way to pump back fuel from the fuel supply circuit 40. This may be especially suited to the variants stated above having none of the exhaust fuel shut-off valve arrangement and of the dosing valve controlled depending on the pressure in the fuel supply circuit.

It can be seen in the above embodiments that the fuel system do not comprise any additional pump in the fuel supply circuit between the primary fuel pump 30 and the exhaust nozzle 56. In particular, it has no pump in the exhaust branch 44 of the fuel supply circuit 40, downstream of the separation point 43.

It is to be understood that the present invention is not limited to the embodiments described above and illustrated in the drawings; rather, the skilled person will recognize that many changes and modifications may be made within the scope of the appended claims.

The invention claimed is:

1. A fuel system for delivering pressurized fuel both to an internal combustion engine and to an exhaust installation, the fuel system comprising a fuel supply circuit having two separate branches: an engine branch for delivering fuel to the internal combustion engine and an exhaust branch for delivering fuel to the exhaust installation, a primary fuel pump delivering fuel to both branches of the fuel supply circuit wherein the primary fuel pump output is controllable independently of the engine speed, and a hydraulically controlled exhaust fuel shut-off valve in the exhaust branch, the hydraulically controlled exhaust fuel shut-off valve being configured to switch between a shut-off state and an open state depending on a pressure in the fuel supply circuit compared to a threshold pressure, and wherein the hydraulically controlled exhaust fuel shut-off valve is controlled by controlling a primary fuel pump outlet that results in controlling the pressure in the fuel supply circuit.

2. Fuel system according to claim 1, wherein the pump output may be controlled such that the pressure of fuel in the fuel supply circuit depends on whether fuel is to be delivered to the exhaust installation.

3. Fuel system according to claim 1, wherein the hydraulically controlled valve arrangement has a hydraulic control port which is connected to the fuel supply circuit.

4. Fuel system according to claim 3, wherein the hydraulic control port is connected to the exhaust branch of the fuel supply circuit.

5. Fuel system according to claim 1, wherein the hydraulically controlled exhaust fuel shut-off valve arrangement comprises a hydraulically controlled exhaust fuel shut-off valve which has a hydraulic control port connected to the fuel supply circuit upstream of the hydraulically controlled exhaust fuel shut-off valve.

6. Fuel system according to claim 5, wherein the hydraulically controlled exhaust fuel shut-off valve is elastically biased towards a shut-off state, against the action of the pressure at its hydraulic control port.

7. Fuel system according to claim 1, wherein the fuel supply circuit, comprises, downstream of the hydraulically controlled exhaust fuel shut-off valve arrangement, at least one nozzle for injecting fuel into an exhaust gases stream.

8. Fuel system according to claim 1, wherein the fuel system comprises an electromagnetically controlled dosing valve downstream of the exhaust fuel cut-off valve arrangement in the fuel supply circuit exhaust branch.

9. Fuel system according to claim 1, wherein the fuel system comprises a purge system comprising a purge control valve arrangement which has an inlet connectable to a pressurized purge fluid source and an outlet which is connected to the exhaust branch of the fuel supply circuit.

10. Fuel system according to claim 9, wherein, the purge control valve arrangement comprises at least one hydraulically controlled purge fluid control valve having a hydraulic control port which is connected to the fuel supply circuit.

11. Fuel system according to claim 10, wherein the hydraulic control port is connected to the exhaust branch of the fuel supply circuit.

12. Fuel system according to claim 9, wherein the outlet of the purge control, valve arrangement is connected to the exhaust branch of the fuel supply circuit upstream of a nozzle for injecting fuel into an exhaust gas stream.

13. Fuel system according to claim 9, wherein purge control valve arrangement comprises a valve which is forced to a shut-off state when the pressure in the fuel supply circuit upstream of the exhaust fuel shut-off valve arrangement exceeds a threshold pressure.

14. Fuel system according to claim 9, wherein the purge control valve arrangement is arranged fluidically between the pressurized purge fluid source and the exhaust branch of the fuel supply circuit, and is hydraulically controlled by the pressure of fuel in the fuel supply circuit, wherein the purge control valve arrangement is open when the pressure of fuel in the fuel supply circuit is comprised between a first threshold pressure and a second threshold pressure, and wherein the purge control valve arrangement is closed when the pressure of fuel in the fuel supply circuit is lower than the first threshold pressure and higher than the second threshold pressure.

15. Fuel system according to claim 14, wherein the purge control valve arrangement comprises at least two hydraulically controlled shut-off valves which are arranged in series between the pressurized purge fluid source and the exhaust branch of the fuel supply circuit, which are both hydraulically controlled by the pressure of fuel in the fuel supply circuit, where one of the valves is a normally open valve and the other is a normally closed valve, and where each valve has a different threshold pressure for switching from a rest position to a forced position.

16. Fuel system according to claim 15, wherein purge control valve arrangement comprises:

a normally closed valve which is forced to its open state when the pressure in the fuel supply circuit exceeds the first threshold pressure, and which is elastically biased towards a closed state against the action of the pressure at a hydraulic control port and a normally open valve which is forced to a shut-off state when the pressure in the fuel supply circuit exceeds the second threshold pressure, and which is elastically biased towards an open state against the action of the pressure at a hydraulic control port.

17. Fuel system according to claim 1, comprising a purge system comprising a purge control valve arrangement which has an inlet connectable to a pressurized purge fluid source and an outlet which is connected to the exhaust branch of the fuel supply circuit, a the purge control valve arrangement, which is arranged fluidically between the pressurized purge fluid source and the exhaust branch of the fuel supply circuit, and which is hydraulically controlled by the pressure of fuel in the fuel supply circuit, in that the purge control valve arrangement is open when the pressure of fuel in the fuel supply circuit is comprised between a first threshold pressure and a second threshold pressure, and in that the purge control valve arrangement is closed when the pressure of fuel in the fuel supply circuit is lower than the first threshold pressure and higher than the second threshold pressure, wherein a hydraulic control port of the purge fluid control valve arrangement is connected to the exhaust branch upstream of the fuel shut-off valve.

18. Fuel system according to claim 1, comprising a purge system comprising a purge control valve arrangement which has an inlet connectable to a pressurized purge fluid source and an outlet which is connected to the exhaust branch of the fuel supply circuit, the purge control valve arrangement, which is arranged fluidically between the pressurized purge fluid source and the exhaust branch of the fuel supply circuit, and which is hydraulically controlled by the pressure of fuel in the fuel supply circuit, in that the purge control valve arrangement is open when the pressure of fuel in the fuel supply circuit is comprised between a first threshold pressure and a second threshold pressure, and in that the purge control valve arrangement is closed when the pressure of fuel in the fuel supply circuit is lower than, the first threshold pressure and higher than the second threshold pressure, wherein the exhaust fuel shut-off valve is a hydraulically controlled fuel shut-off valve arrangement which is forced to open when the pressure upstream of the exhaust fuel shut-off valve arrangement exceeds a threshold pressure which is higher than the first threshold pressure and higher than the second threshold pressure.

19. Fuel system according to claim 1, wherein the engine branch of the fuel supply circuit comprises at least one high pressure fuel pump which is fed by the primary fuel pump.

20. Fuel system according to claim 1, wherein the fuel supply circuit comprises no additional pump in the fuel flow between the primary fuel pump and a nozzle for injecting fuel into an exhaust gases stream.

21. Fuel system according to claim 1, wherein the fuel system comprises a controller unit for controlling the primary fuel pump in such a way to pump back fuel from the fuel supply circuit.

22. Fuel system according to claim 1, wherein the fuel system comprises an electric motor for driving the primary fuel pump.

23. An internal combustion engine arrangement comprising an internal combustion engine having at least one engine cylinder in which fuel is combusted to provide mechanical energy to a piston;

an exhaust installation in which flow exhaust gases collected from the internal combustion engine wherein the internal combustion engine arrangement comprises a fuel system according to claim 1 wherein fuel is supplied to the at least one engine cylinder by the engine branch of the fuel supply circuit and wherein fuel is supplied to the exhaust installation by the exhaust branch of the fuel supply circuit.

24. Fuel system according to claim 1, wherein the primary fuel pump output is controllable such that:

the pressure in the fuel supply circuit remains below the threshold pressure when no fuel is to be delivered to the exhaust installation, and the pressure in the fuel supply circuit exceeds the threshold pressure when fuel is to be delivered to the exhaust installation and to control the switch of the exhaust fuel shut-off valve arrangement from the shut-off state to the open state.

* * * * *